US009599111B2

(12) United States Patent
Morando

(10) Patent No.: US 9,599,111 B2
(45) Date of Patent: Mar. 21, 2017

(54) RISERLESS RECIRCULATION/TRANSFER PUMP AND MIXER/PRE-MELTER FOR MOLTEN METAL APPLICATIONS

(76) Inventor: Jorge A. Morando, Solon, OH (US)

( * ) Notice: Subject to any disclaimer, the term of this patent is extended or adjusted under 35 U.S.C. 154(b) by 988 days.

(21) Appl. No.: 13/285,766

(22) Filed: Oct. 31, 2011

(65) Prior Publication Data

US 2012/0163959 A1 Jun. 28, 2012

(51) Int. Cl.
*F04D 1/14* (2006.01)
*F04D 7/06* (2006.01)
*F04D 29/44* (2006.01)

(52) U.S. Cl.
CPC ..... *F04D 1/14* (2013.01); *F04D 7/065* (2013.01); *F04D 29/445* (2013.01)

(58) Field of Classification Search
CPC ..... F04D 1/14; F04D 7/065; F04D 29/445
USPC ... 415/89, 189.1, 203, 206, 212.1, 222, 226; 416/198 R, 231 A; 417/423.14, 423.1, 417/424.1; 266/235
See application file for complete search history.

(56) References Cited

U.S. PATENT DOCUMENTS

| | | | | |
|---|---|---|---|---|
| 3,575,531 | A * | 4/1971 | Buckingham | 416/170 R |
| 4,286,985 | A * | 9/1981 | Van Linden et al. | 75/687 |
| 5,630,863 | A * | 5/1997 | Eckert | 75/680 |
| 7,326,028 | B2 * | 2/2008 | Morando | 415/88 |
| 2010/0104415 | A1 * | 4/2010 | Morando | 415/1 |

* cited by examiner

*Primary Examiner* — Craig Kim
*Assistant Examiner* — Jason Davis
(74) *Attorney, Agent, or Firm* — Fay Sharpe LLP

(57) ABSTRACT

A pump for processing molten metal having an enlarged tubular body which houses a centrifugal lifting pump at its bottom end. The bottom end has a curved shape that aids in the formation and sustainability of: a) a forced vortex; b) a highly forced vortex; and c) a super forced vortex, depending on the application when it which receives the ejected molten metal from the lifting pump's impeller. The lifting pump is controlled to cause the vortex to climb up the inner wall of the body up to and out of an outlet formed in the upper end of the body. A recirculation centrifugal pump is mounted coaxially to and rotates with the lifting impeller.

19 Claims, 9 Drawing Sheets

RISERLESS RECIRCULATION/TRANSFER PUMP AND MIXER/PRE-MELTER FOR MOLTEN METAL APPLICATIONS

FIELD OF THE INVENTION

The present invention relates to lifting, mixing, and recirculating molten metals and, more particularly, to a pump creating a vortex within a lift tube to elevate and mix molten metal.

BACKGROUND AND SUMMARY OF THE INVENTION

A typical molten metal facility includes a furnace with a pump for moving molten metal. During the processing of molten metals, such as aluminum and zinc, the molten metal is normally continuously circulated through the furnace by a centrifugal circulation pump to equalize the temperature of the molten bath. These pumps contain a rotating impeller that draws in and accelerates the molten metal creating a laminar-type flow within the furnace.

To transfer the molten metal out of the furnace, typically for casting the metal, a separate centrifugal transfer pump is used to elevate the metal up through a discharge conduit that runs up and out of the furnace. As shown in FIG. 1, a typical prior art transfer pump includes a base 5, two to three support posts 6 (only one shown), a shaft-mounted impeller 7 located within a pumping chamber or volute 5*a* in the base 5, a motor 8 and motor mount 9 which turn the impeller, bearings 10 that support the rotating impeller (and shaft), and a riser tube or conduit 11 located at the outlet of the base. The riser 11 is provided to allow the metal to lift upward over the sill edge of the furnace in order to transfer some of the molten metal 12 out of the furnace into ladles or molds.

A well-known problem with previous transfer pumps, however, is that the relatively narrow riser tube 11 becomes clogged as small droplets of the molten metal accumulate in the riser each time the pump stops transferring and the metal stops flowing through the riser. Initially, the metal accumulates in the porosity of the riser tube material (typically graphite or ceramic) and then continues to build upon the hardened metal/dross until a clog 13 occurs. As a result of this problem, furnace operators must frequently replace the transfer pump's riser tube as they are too narrow to effectively clean. This replacement typically requires the furnace to be shut down for an extended period to remove the clogged riser tube.

Several treatments have been used to alleviate this riser-clogging in transfer pumps. Including impregnating, coating, and inert gas pressurization of the riser to reduce the build-up within the tube. Another method pump manufacturers employ is to simply increase the diameter of the riser to delay the blockage. These treatments have varying degrees of success, but still only delay the inevitable clogging of the riser.

Another common operation in a molten metal facility is to add scrap metal, typically metal working remnants or chips, to the molten bath within a furnace. The heat of the bath melts the chips. Currently, the added chips are simply allowed to fall into the bath or may be mixed into the molten metal by a circulation pump. The current process(es), however, is not effective to fully immerse the solid chips into the molten bath resulting in a longer melt time. As shown in FIG. 2, prior art systems utilizing a dedicated mixing pump 14 directs molten metal 12 into a vessel 15 resulting in a nearly free vortex 16 to be formed. Scrap metal, such as chips 17, are deposited into the vortex 16 to mix and melt the chips 17 within the molten metal bath 12. As will be discussed in greater detail below, these nearly free vortex-based systems do not provide sufficient residence times within the bath to efficiently melt and mix the newly deposited chips into the bath. A nearly free vortex 16, such as the type formed by prior art systems are governed by the following equations $\omega=Cr^{-2}$, $Vr=C$, $P/\gamma=C/2gr+h$, where $\omega$ is the angular velocity, V is the peripheral velocity, $P/\gamma$ is the pressure distribution (pressure energy) and h is the static energy. Then the maximum velocity would be at the center axis of the vortex, expelling the chips upward and outwards. Consequently, any metal particles introduced therein will float at the top of the metal and exit without being melted at the top exit outlet, generating a large amount of dross instead of liquid metal. The resulting shape of vortex 16 is shown in FIG. 12.

Presently, molten metal facilities have limited furnace footprints with relatively small pump wells and charge wells. The limited space available typically prevents furnace operators from having permanently installed transfer pumps and/or mixer/pre-melter systems within a furnace (in addition to the recirculation pump). There is therefore a need for a system that can combine two or more of the transfer/pre-melt/recirculation processes within a single pump.

Another drawback of conventional molten metal pumps is the highly inefficient use of very large/high horsepower motors which are stepped down in velocity electronically with a frequency converter that maintains the torque constant, thus reducing the output horsepower when running the equipment at a safe RPM. The present invention provides for a mechanical gear box which provides for the desired reduction in RPMs, while boosting the torque and permitting the motor to operate at or near its optimal speeds to further increase efficiency. The gear box necessitates another improvement to existing molten metal pumps to avoid the undesirable transfer of heat from the molten bath into the gear train and pump motor. This further improvement is a coupling that operates as a thermal barrier between the drive shaft that is submerged within the bath to rotate the pump impeller and the upper portion of the shaft that is driven by the gear train.

In view of the current inefficient use of molten metal transfer and mixing pumps, there is a need for a molten metal pump that overcomes all of the above-indicated drawbacks.

The present invention provides a molten metal pump including an elongated body or vessel having an elongated bowl or tube that terminates in a curved bottom end. A centrifugal impeller is seated in an inlet opening formed in the center of the bottom end. The shape of the vessel's bottom end provides a smooth upward transition for metal ejected from the impeller to the inner walls of the tube. The rotation of the impeller centered in the curved lower walls results in the ejected flow of molten metal to create an uplifting vortex which climbs the inner walls of the vessel to an outlet opening in an upper portion wall. The pump is preferably a hybrid-drag turbine type disclosed in my U.S. Pat. No. 8,033,792 which is incorporated herein.

Further, the present molten metal pump includes a second centrifugal impeller mounted coaxially to the vortex lifting impeller. The second centrifugal impeller is a recirculation pump and is preferably a turbine impeller such as the ones disclosed in my U.S. Pat. No. 7,896,617 (turbine) which is incorporated herein and which provides a very high outlet peripheral velocity.

The vessel's shape (i.e., the curvature of the inner wall and bottom end) is a function of the type of vortex required by the particular application. Particularly, I have determined that the optimum vortex for transfer-only applications maintains a constant angular velocity using an internally curve-shaped vessel that concurs with the following equations $\omega$=CTE (constant, i.e., $\omega=Cr^0$ with $Vr^{-1}=C$), $P/\gamma=Cr^2/2g+h$. The constant angular velocity of the liquid metal moves like a solid, while twisting and turning upwards in the vessel without each molecular layer sliding with respect to the adjacent layer minimizing the possibility of turbulence, loss of heat and viscous windage losses.

Further, I have determined that the optimum vortex for a mixing/pre-melting application requires an internally curve-shaped vessel when flows greater than 1500 GPM are required follow the equations $\omega=Cr$, $Vr^{-2}=C$, $P/\gamma=Cr^4/4g+h$. A curve that follows the equations $\omega=Cr^{1/2}$ with $Vr^{-3/2}=C$, $P/\gamma=Cr^3/3g+h$ will suffice for lower flow rates. The vortex created in a mixing/pre-melting application should be a highly forced or super forced vortex to assure the penetration of the particles of added material into the matrix of partially combined material. To ensure adequate churning or slipping between adjacent molecular layers the angular velocity is higher toward the periphery of the vortex. At higher flow rates a hyperbolic-shaped vessel creates a super forced vortex requiring a hybrid-drag turbine type impeller such as the type disclosed in my U.S. Pat. No. 8,033,792. At lower flow rates a turbine impeller may be used to generate the flows and velocities necessary, such as the type disclosed in my U.S. Pat. No. 7,896,617.

The present invention further provides an improved system for transmitting the requisite torque to the combined impellers. The present power transmission includes a mechanical gear train which reduces the revolutions per minute from the pump's electric motor, while also boosting the torque being applied along the output shaft.

The present invention still further provides a self cooling thermal barrier coupling which transmits the torque from the motor/gear box, while limiting the conduction of heat from the molten metal bath to the motor and gear box.

It is an advantage of the present invention to provide a pump which creates a forced, highly forced or super forced vortex of molten metal within a generally vertical tube body of the pump to lift the whirling molten metal for transferring, mixing, and/or pre-melting applications.

It is another advantage of the present invention that the lifting cavity has a relatively large internal diameter allowing the inner walls to be readily accessed for cleaning and removal of accumulated metal and dross. Preferably, the vessel internal diameter being between 1.5 to 4 times the impeller outside diameter.

It is still another advantage of the present invention that two coaxial impellers are driven by a common drive motor-shaft design to simultaneously provide the lifting vortex flow and the recirculation flow. An upper impeller being mounted within the tubular lifting vortex cavity, while the lower impeller is mounted within a volute to recirculate a bath of molten metal.

It is still yet another advantage of the present invention that the lifting vortex cavity has a curved shape and size that complements the intended vortex formed therein. That is, in a transfer application, the lifting cavity has a particular curvature shape, while in a pre-melting/mixing application the lifting vortex cavity has at least a third degree curved shape as described above (e.g., has a pressure distribution following $P/\gamma=C^2r^3/3g+h$ or $P/\gamma=C^2r^4/4g+h$).

An advantage of the present invention over prior art transfer-type pumps is that the present invention eliminates the support posts, riser tube, and one impeller bearing thereby reducing the complexity of the pump system and reducing the number of components subject to deterioration due to the molten metal environment and which must eventually be replaced.

It is an additional advantage of the present invention when mixing or pre-melting to provide an upper impeller having a plate with a plurality of radial vanes facing into the tubular body. When metal scrap chips are inserted into the pump's tubular cavity, the plurality of radial vanes on the upper impeller causes the metal chips to be directed radially outwardly into the pump-generated uplifting vortex of molten metal. The rotational velocity of the impeller causes the chips to further penetrate the surface of the vortex to fully immerse the chips within the molten metal.

It is yet another advantage of the present invention that the dual impellers are driven by the motor through a mechanical gear train which increases the torque transmitted to the output shaft and permits the motor to run near its optimal operating speed by reducing the rotational speed of the output shaft to a desired amount.

These and other objects, features and advantages of the present invention will become apparent from the following description when viewed in accordance with the accompanying drawings.

BRIEF DESCRIPTION OF THE DRAWINGS

The description refers to the accompanying drawings in which like reference characters refer to like parts throughout the several views, and in which:

FIGS. 5 and 6 provide a side by side comparison of the vessel profile and differing impellers generating the two applications;

DETAILED DESCRIPTION OF THE INVENTION

Figure 1:
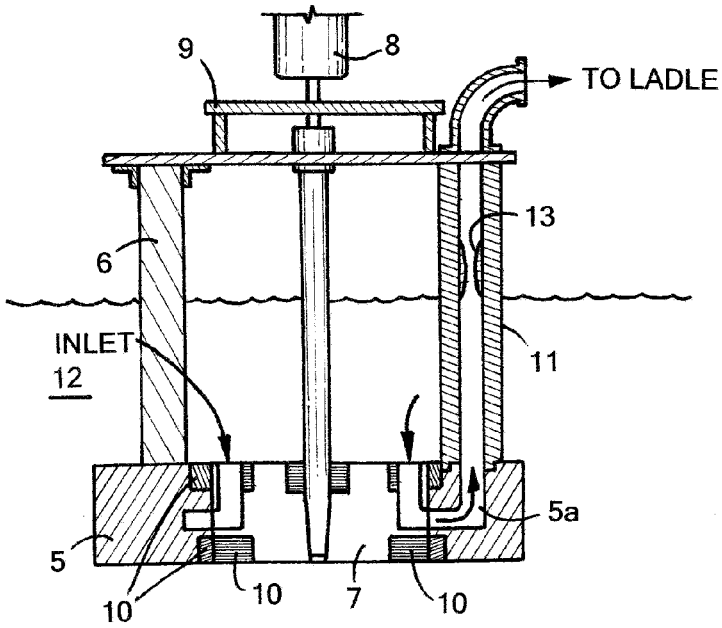
FIG.1 (PRIOR ART)
FIG. 1 is a side sectional view of a prior art transfer pump having a riser tube.
Figure 2:
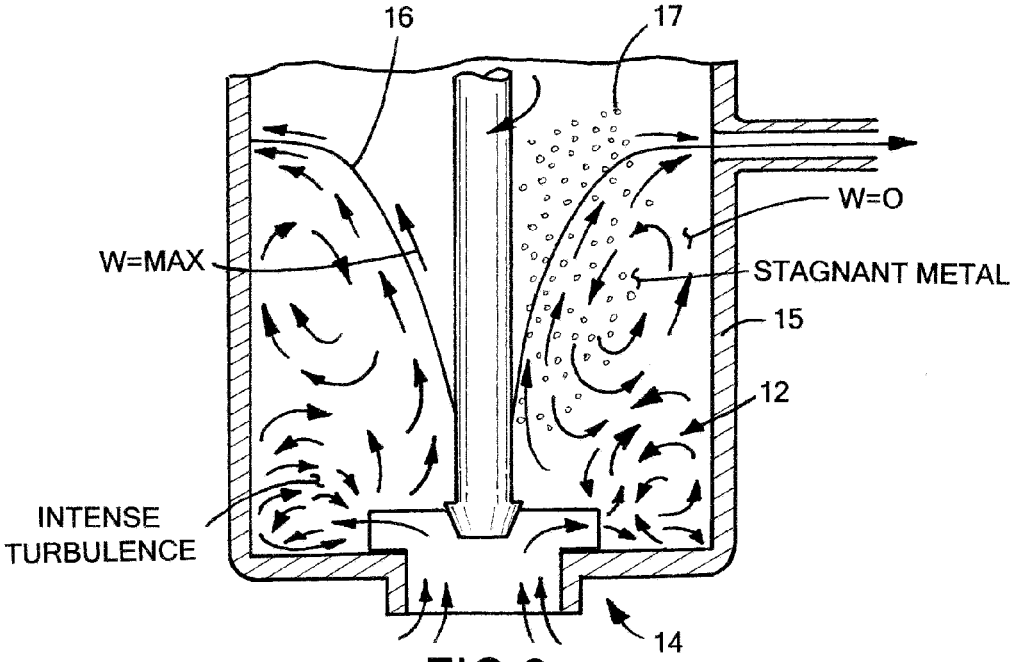
FIG.2 (PRIOR ART)
FIG. 2 is a side section view of prior art mixer producing a nearly free vortex.
Figure 3:
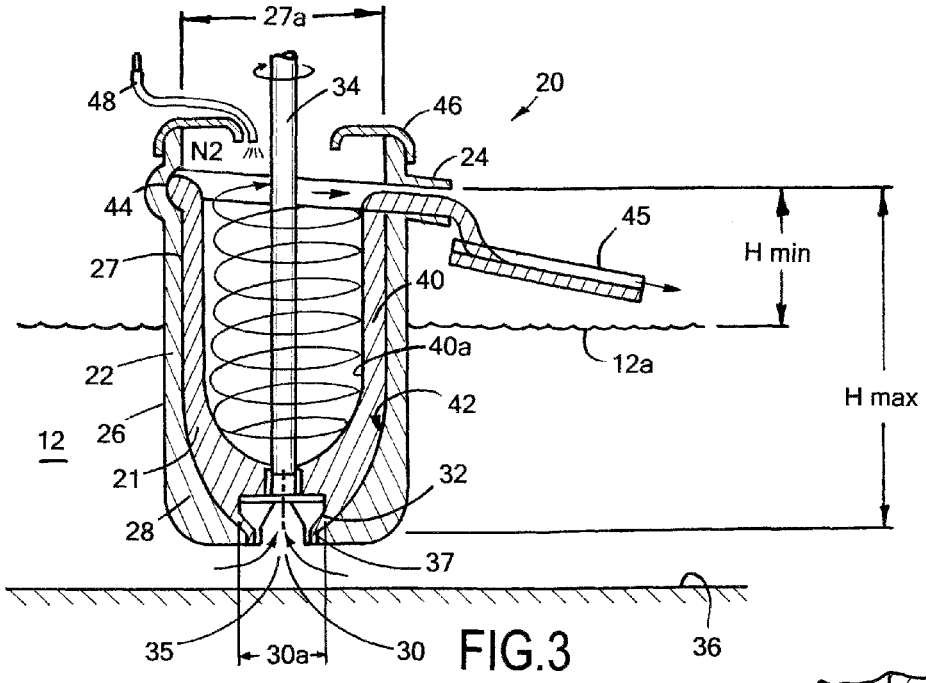
FIG. 3 is a side sectional view of a transfer pump embodiment of the present invention.

Referring now to FIG. 3, the present invention is molten metal pump 20 which creates a forced vortex of accelerated molten metal 21 within a vertical tube 22 in the pump to lift or raise the molten metal to an outlet 24 in the upper end of the pump.

Pump 20 includes an elongated tubular pump body or vessel 26 having a generally vertical inner tube wall 27 and a curved or dome-shaped bottom end 28. As will be discussed in greater detail below, the cavity-defining profile of the bottom end 28 and inner wall are a consequence of the type of vortex selected, $\omega=Cr^m$, where m is based on a design criteria that depends on the lifting application. For a transfer pump, I have selected m=0. In other embodiments, the profile may be spherical or perhaps elliptical. An inlet opening 30 is formed in the center of the concave lower end 28. A centrifugal impeller 32 is mounted within opening 30 and is rotated by an elongated output shaft 34 which runs concentrically down through the center of tube body 26. Shaft 34 is driven by a conventional motor 135 (such as the motor illustrated in FIG. 14). In the embodiment illustrated, inlet opening 30 and the impeller's inlets are suspended above the furnace floor 36 to ensure an adequate amount of molten metal is pulled into pump 20.

Impeller 32 rotates on bearings 37 disposed between the impeller and body 26 to draw in molten metal from bath/matrix 12, which is accelerated in the radial and tangential directions and is upwardly lifted by the Coriolis force that with the assist of the transition angle $\alpha$, denoted 43, overcomes the g-forces at very high peripheral velocities. Since the condition of equilibrium requires that the centrifugal force must be balanced by the static liquid column at the same point it follows that: $dP/dr=\gamma V^2/gr=\gamma\omega^2 r/g$. The rotating impeller 32 expels the accelerated molten metal out of the impeller and into bottom end 28 of the pump body. Impeller 32 is preferably a type to generate the molten metal lifting vortex within pump 20, such as the impeller configurations disclosed in: a) my issued U.S. Pat. No. 7,326,028 patent, hereinafter referred to as a dual inducer impeller; b) my issued U.S. Pat. No. 7,896,617, hereinafter referred to as a turbine impeller; both with very high peripheral velocities and which are each incorporated herein by reference.

The pump body 26 is preferably formed from a material suitable for molten metal applications, such as a boron nitride impregnated refractory material. It should be appreciated that since most transfer-type molten metal pumps typically only need to lift the metal three to seven feet vertically, the lifting cavity portion of the pump body has a similar overall length/height.

Figure 4:
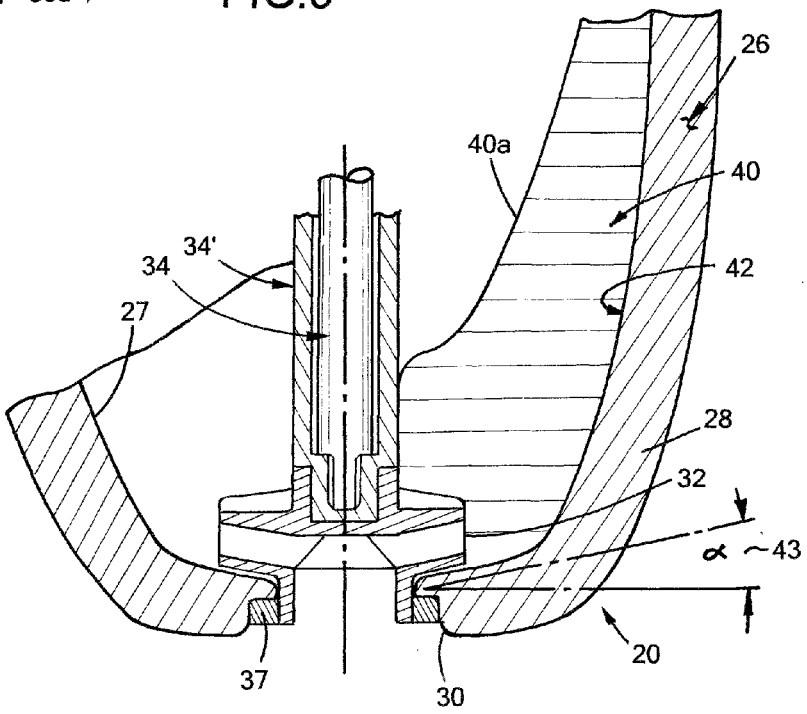
FIG. 4 is a partial side sectional view of the transfer embodiment and the curved lower portion of the lifting vessel.
Figure 5:
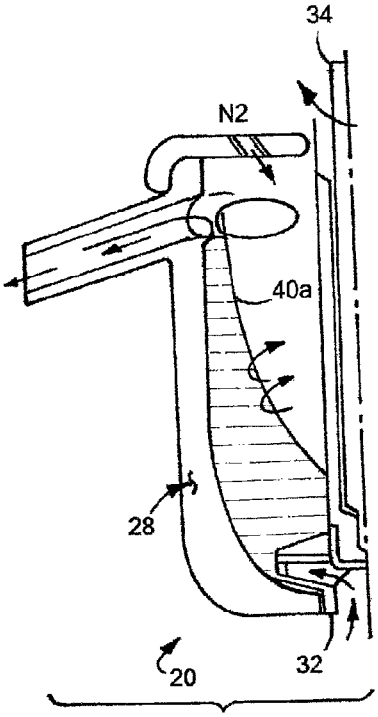
FIG. 5 is a partial side sectional view of the transfer pump embodiment generating a forced vortex with constant angular velocity.

In the embodiment illustrated in FIGS. 3-5, tube 26 terminates in a curved-shaped end 28, which provides the contour necessary for the impeller to generate the forced-type vortex required by the application at hand.

In this embodiment, a transferring application is illustrated where the curved shape of end 28 has its curvature focus proximate to its vertex. Further in this transferring application, the forced vortex 40 has a constant angular velocity, $\omega=Cr^0$, (i.e., where there is little to no shear in the fluid such that the fluid essentially rotates as a solid body) generated by the rotating impeller.

Importantly, I have determined that the profile of the inner surfaces 27, 28 of the lifting vessel in combination with the outlet flow velocity from the impeller predicates the types of vortices generated. In a preferred embodiment of this transfer application, an "ordinary" forced vortex 40 is generated where the free surface 40*a* is nearly a square (or second degree curve) curve resulting in a varying radial thickness or depth of the molten metal, which narrows as the flow rises up the tube walls 27. That is, more molten metal can be found proximate to the lower end 28 in pump body 26 than at the upward end of the vertical tube.

As described above, a forced vortex 40 exhibits little to no internal shear within the liquid. The forced vortex 40 having a constant angular velocity, $\omega=Cr^0$ wherein $C=Vr^{-1}$. This assures the liquid metal is moving like a solid, while twisting and turning upwards in the vessel without each adjacent molecular layer sliding with respect each other, thereby minimizing the possibility of turbulence, loss of heat and viscous windage losses. The pressure distribution is then given by: $P/\gamma=C^2r^2/2g+h$, which is theoretically a square parabola curve. I have determined that the vertical cross section configuration of a lifting vessel for a transfer application with a parabolic curve plus the assist of a two degree to a fifteen degree starting lift angle $\alpha$ (43) beginning at the inlet opening 30 of the vessel is the optimal configuration. Optimally, the angle 43 is between two and ten degrees.

In the preferred embodiment of a transferring pump, body 26 includes an exit volute 44 in the upper end of the body. Exit volute 44 is a channel recessed in body 26 which redirects the whirling vortex 40 of molten metal out through outlet opening 24.

In a transferring application, the outlet opening 24 leads onto a conventional molten metal sluice 45 to move the exiting molten metal away from the furnace.

The maximum lift, "Hmax", (i.e., the maximum vertical distance a given pump 20 will elevate a given molten metal from the inlet of the impeller) will depend on: a) the internal diameter 27*a* of the pump body's tube; b) the impeller's outer diameter 30*a*; and c) the speed (in rpm) at which the impeller 32 is rotated. For optimum transfer lift the impeller's outer diameter 30*a* is preferably within the range of one-third to one-half the internal diameter 27*a* of the pump body tube 27. The minimum lift, "Hmin", is the vertical distance between the molten metal line 12*a* in the furnace and the height to the outlet opening 24, which results in sufficient material exiting the pump 20 to maintain the desired vortex formed by the incoming/accelerating molten material.

Figure 9:
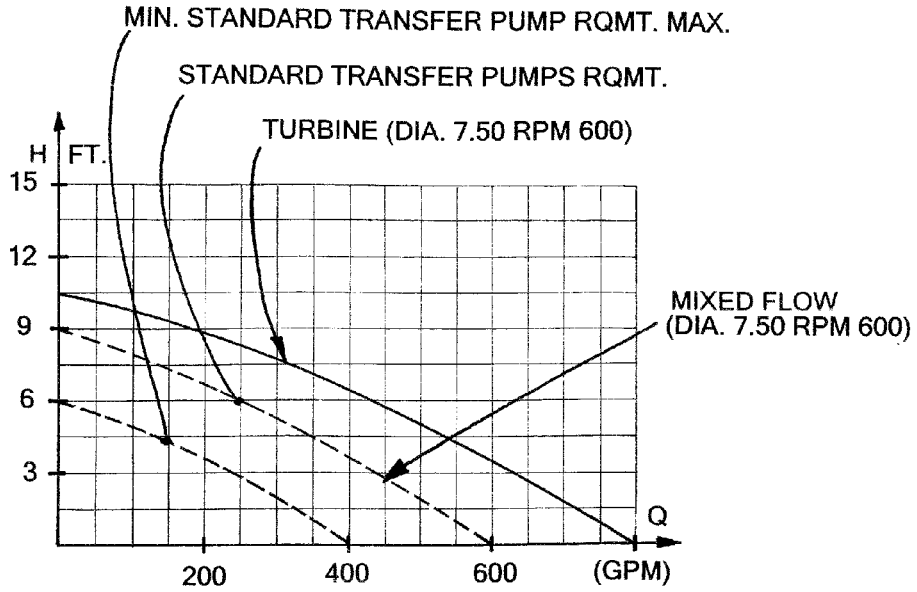
FIG. 9 shows the minimum and standard transfer pump requirement curves for head and flow for a 7.5 inch impellers operating at 600 rpms.

Referring now to FIG. 9, the distribution curves of the necessary flow to lift requirements for transfer pumps with traditional impeller configurations (such as a mixed flow impeller) and a turbine impeller are shown for the same sized impellers running at the same speeds. As shown, the flow rates, Q, for my turbine impeller far exceed the rates of more traditional impellers at any desired lifting heights.

Pump 20 further preferably includes an annular lid or splash protector 46 which substantially covers the upper open end of the tube body 26 while leaving a central opening to allow access for the drive shaft 34. In one embodiment, pump 20 includes a gas injection tube or conduit 48, which passes into cavity 42 to introduce an inert gas into the molten metal, such as injecting nitrogen gas to flux/clean molten aluminum and prevent the formation of aluminum oxide ($Al_2O_3$).

Figure 6:
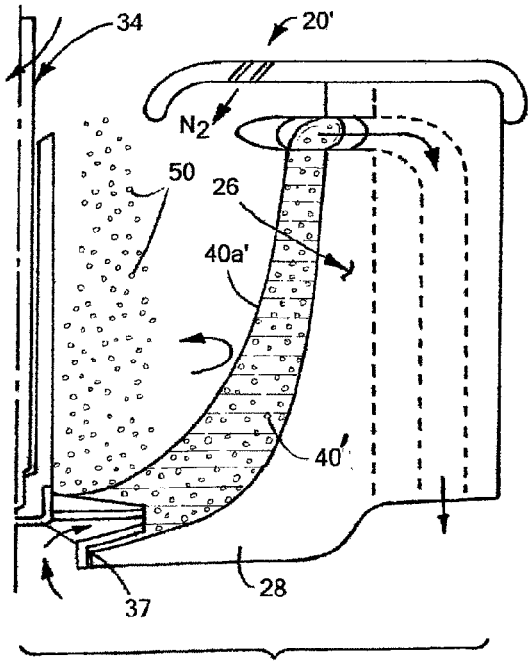
FIG. 6 is a partial side sectional view of a mixing/pre-melting embodiment of the present invention.
Figure 7:
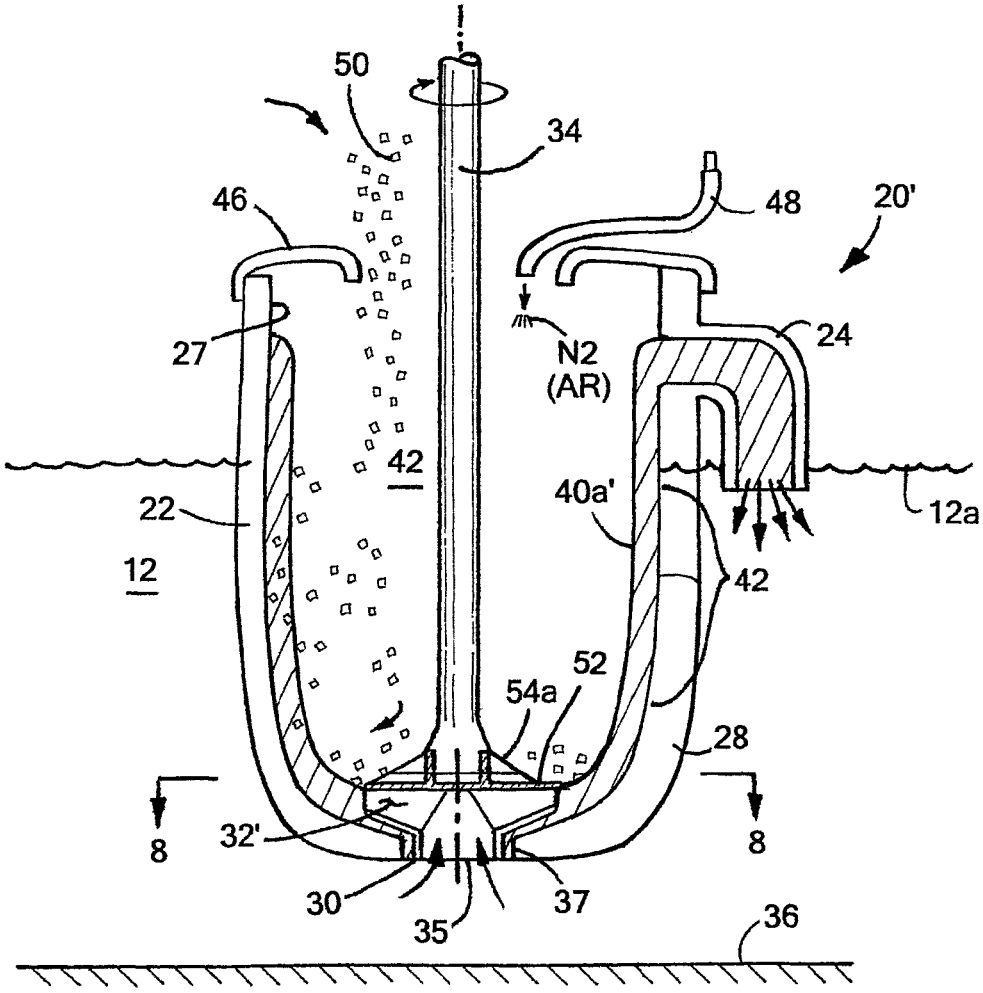
FIG. 7 is a side sectional view of the mixing/pre-melting embodiment generating a super forced vortex produced within a lifting vessel with hyperbolic-shaped inner wall.
Figure 8:
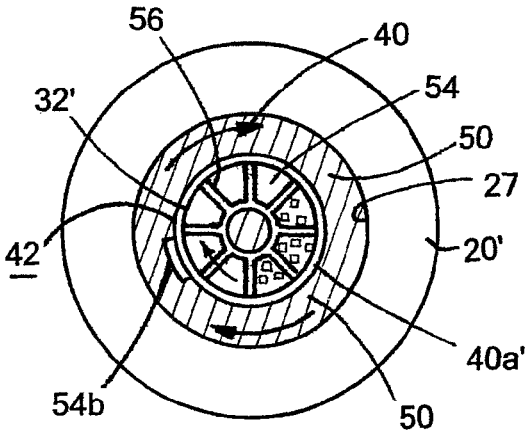
FIG. 8 is a top sectional view through line 8-8 in FIG. 7 showing the radially accelerated metal particles penetrating the impeller induced vortex.

Referring now to FIGS. 6-8, in an alternate embodiment the pump 20' is used as a metal mixer or pre-melter, chips or particles 50 of various materials are introduced into body 26 through the upper end. In one embodiment, the curved shape of cavity bottom 28 and inner wall 27 has a wider nearly hyperbolic configuration than the transferring pump above, with the focus being as far as practicable from the vertex. In the mixing application, the height of the lifted metal should be maintained at a minimum to ensure proper dispersion of the particles 50 added for mixing with the metal matrix/bath 12. This will depend on: a) the materials being mixed; b) the particles' size; c) the wettability of the particles; d) the mixing speed (rpm); and e) the impeller configuration and tip velocity. In a preferred embodiment of this mixing application, highly forced vortex 40' or even a super forced vortex is generated where the free surface 40*a*' is a cubic curvature of the type $P/\gamma=C^2r^3/3g+h$ resulting in a near constant radial thickness or depth of the molten metal, which remains uniforms as the flow rises up the tube walls 27 and the angular velocity is higher toward the periphery and slower at the center axis $\omega=Cr^{1/2}$. Note that r is to the third power and $V=C/r^{3/2}$, generating a very strong upper lift.

When the resulting flow and exit velocities are large enough, the resulting vortex within the vessel takes the shape of what I have termed a "super forced vortex", where the vortex 40" of fluid forms a near constant or uniform depth/thickness and the free surface 40*a*" of the fluid has substantially the same curved shape as the underlying cavity 42 (defined by tube 27 and dome-shaped end 28) in pump body 26 (FIG. 4).

As shown in FIG. 7, while mixing, the flow out of the pump 20' returns the lifted molten metal to the furnace until the mixing is completed, then casting can start. Preferably, the outlet 24 is located proximate to the furnace metal line 12*a* to reduce turbulence and dross formation.

In a pre-melting system the conditions are similar to the mixing application described above, except the particles' 50 residence time in the vortex 40' or the super forced vortex and the vortex's outlet flow should be such as to guarantee the complete melting of the material 50 added to the vortex to assure sufficient heat is available to cause the solid particles to melt without overcooling either the melting or the melted flow.

In the mixing and pre-melting applications, the highly forced/super vortex would be optimally generated by means of my turbine impeller or hybrid-drag impeller. These impellers generate a very balanced flow versus head performance curve assuring high melting flow and moderate to high recirculation (residence time). In general, it can be stated that the ratio of molten metal flow to required melting pounds of chips is given by $$\frac{QGPM \times 22\frac{\text{lbs}}{\text{gal}} \times 60\frac{\text{min}}{\text{hr}}}{W\frac{\text{lbs}}{\text{hr}}}$$

producing a ratio of pounds of flow per pound of chips. Therefore a successful design must rely not only in the pre-melt recirculation system but on how well the furnace/pre-melt/recirculation combination has been optimized for maximum efficiency, something rarely done at present times.

For optimum mixing or pre-melting applications the internal diameter 27*a* of the lifting cavity 42 is preferably between 1.5 to four times the impeller outside diameter 30*a* to guarantee larger flows and longer residence times of the particles to be melted within or dispersed throughout the metal matrix/bath 12.

Referring now to FIGS. 7 and 8 pump 20' having an impeller 32' which is substantially the same as impeller 32 described above, except that impeller 32' has a much thicker back plate portion 52 (i.e., the face of the impeller opposite to the surface bearing the molten metal inlets 35) than impeller 32. Within the thickened back plate 52 is a plurality of spaced channels 54 which form a plurality of spaced mixing vanes 56 that extend radially outwardly from a central driveshaft mounting hub. These spaced vanes cooperatively form another impeller which directs any material entering channels 54 in a substantially radial outward direction away from the rotating impeller. As shown, when the impeller 32' is inserted within inlet opening 30 of the pump body 26, the inlets 54*a* of channels 54 are open to the internal cavity 42 facing in the opposite direction of lifting impeller inlets 35, while the channel outlets 54*b* face toward the inner wall 27.

In another embodiment, the integrated mixing vane 56 formed within back plate 52 may be replaced with a separate second impeller mounted to the back plate of lifting impeller 32'. Like the integrated vanes, this second impeller would include open channels 54 and vanes 56 substantially the same as those described above.

In a mixing or pre-melting operation, solid particles 50 are introduced into cavity 42 through the upper end of the body 26. As discussed above, when the impeller 32' is turning at rated speed, the flow of molten metal exiting the impeller forms either a highly forced 40' or super-forced vortex which travels up the tube walls 27. The solid particles 50 fall in the axial direction into the inlets 54*a* of the rotating channels 54 formed in the upper surface of back plate 52 and due to the radially extending vanes 56 are re-directed or thrown in a substantially radial direction out of channel outlets 54*b* into the vortex of molten metal. Importantly, the rotational speed of the impeller 32' which is necessary to lift the molten metal up along walls 27 causes the particles 50 being ejected by the radial vanes 56 in the back plate to have sufficient velocity to fully penetrate into the liquid vortex, i.e., beyond the inward-facing surface 40*a* of the vortex, thereby allowing the molten material to fully engulf the solid particles 50 to maximize heating/melting efficiency.

Although the riserless pump 20 has several applications, the general design remains substantially the same except only the lifting capability of the forced vortex 40 is utilized in the transfer application, while the lifting, mixing and recirculation capabilities of the highly forced vortex 40' and super forced vortex 40" are used in conjunction to achieve the ultimate requirements for mixing and pre-melting.

Figure 10:
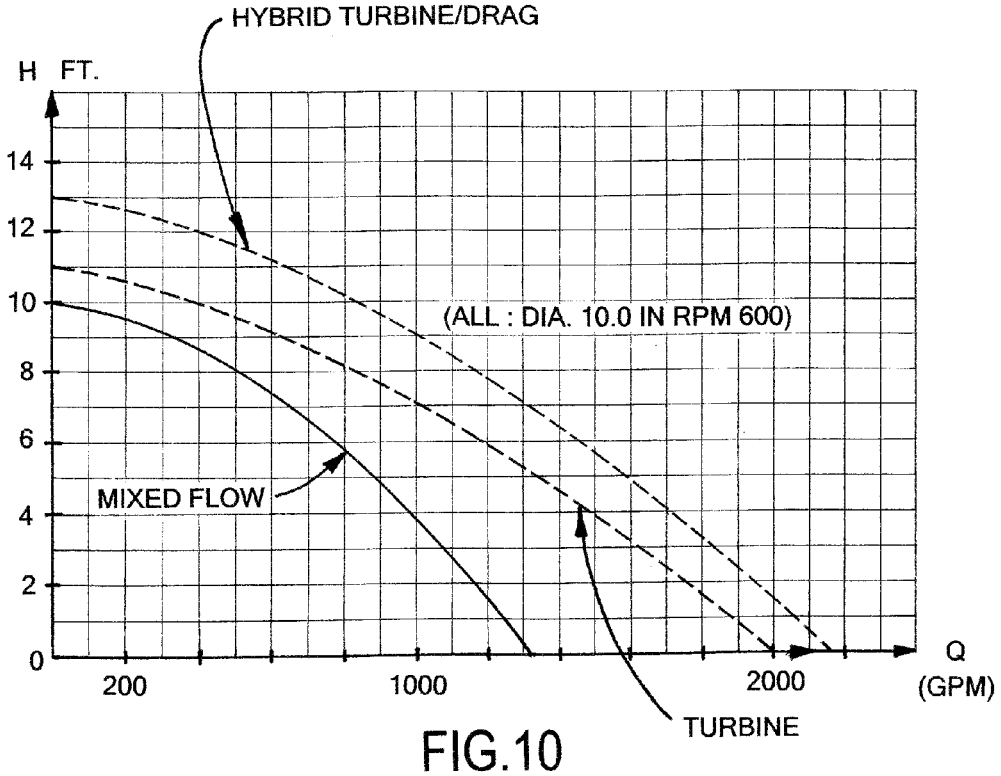
FIG. 10 shows the head to flow rate curves for ten inch impellers of various configurations.

Referring now to FIG. 10, the distribution curves of the necessary flow to lift requirements for mixing and pre-melting pumps with traditional impeller configurations (such as a mixed flow impeller), my turbine impeller, and my hybrid-drag turbine impeller are shown for the same sized impellers running at the same speeds. As shown, the flow rates, Q, for my impellers far exceed the rates of more traditional impellers at any desired lifting heights. These increased flows and high pressures from my impellers allows the formation of the desired highly forced and super forced vortices 40', 40" in these applications. Particularly, these forced vortices 40', 40" having an angular velocity which increases toward the periphery of the vortex (i.e., $\omega=Cr^{1/2}$ to Cr and $v=C/r^2$), also the velocity assures a slip between metal layers (shear) that act in a "churning" motion on the unmelted particles and accelerate the mixture to the top outlet. These vortices have $\omega=Cr^{1/2}$ wherein $C=Vr^{3/2}$. The pressure distribution is then given by: $P/\gamma=C^2r^3/3g+h$, which is a theoretical hyperbolic curve. I have determined that the vertical cross section configuration of the lifting vessel for a mixing/pre-melting application will require a third degree curve (notice $P/\gamma$ above) shaped vessel depending on how "highly" forced the vortex is. Like the forced vortex 40 above, the highly forced and super forced vortices have between a two degree to a fifteen degree starting lift angle $\alpha$ (43) beginning at the inlet opening 30 of the vessel. Optimally, the angle 43 is between two and ten degrees.

It should be appreciated that the above described highly forced and super forced vortices are not easy to generate with molten metals if using standard centrifugal mixed flow pumps or impellers. For that reason I rely upon my hybrid-drag turbine type impeller with total tip velocities generating more than 35% higher flow and shut-off pressures obtained by increasing the peripheral outlet velocity as well as the shut-off coefficient. For example, standard mixed flow pumps have a shut-off pressure coefficient, $Kso\leq0.69$, while my hybrid-drag turbine has $Kso\geq0.90$.

Figure 12:
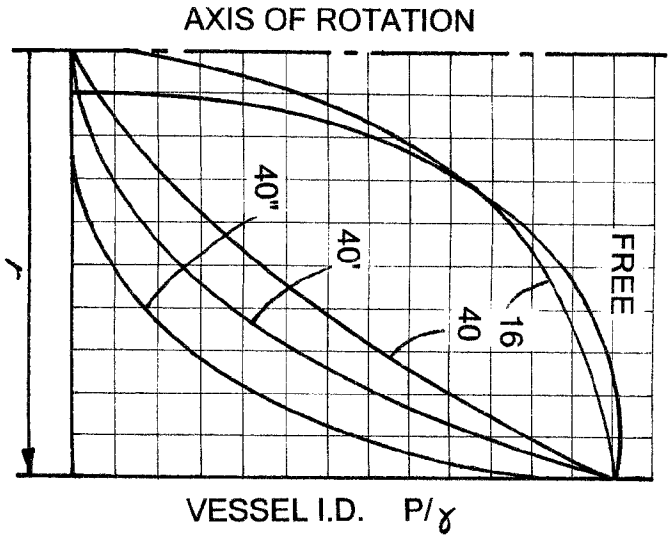
FIG. 12 shows the vortex pressure distribution between different vortex types generated with a lifting vessel.
Figure 11:
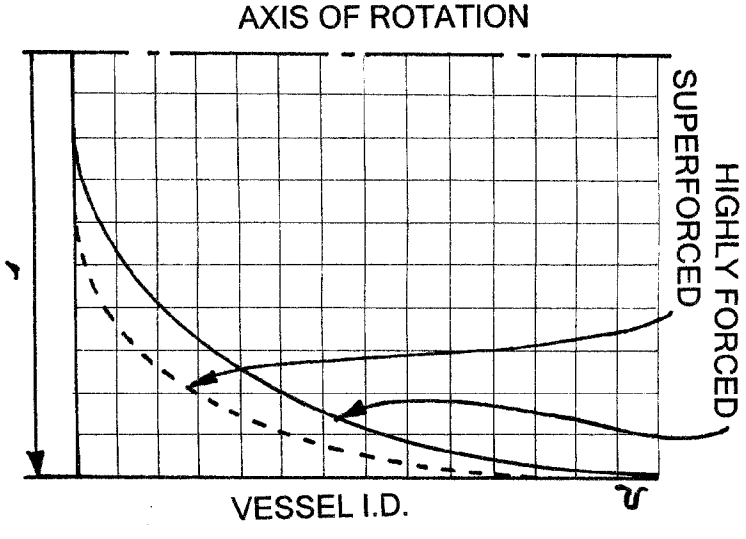
FIG. 11 shows the vortex velocity distribution for different forced vortices.

FIG. 11 illustrates the vortex velocity distribution between a highly forced vortex and a super forced vortex. Similarly, FIG. 12 shows the vortex pressure distribution of various types of vortices, including a free vortex, a constant energy vortex free vortex 16, a constant angular velocity forced vortex 40, a highly forced vortex 40', and a super forced vortex 40". The primary difference between the highly forced and super forced lifting vortices being the velocity of the vortex itself. Thereby distinguishing between the highly forced—closer to a parabolic and super forced—closer to a hyperbolic distribution.

Figure 13:
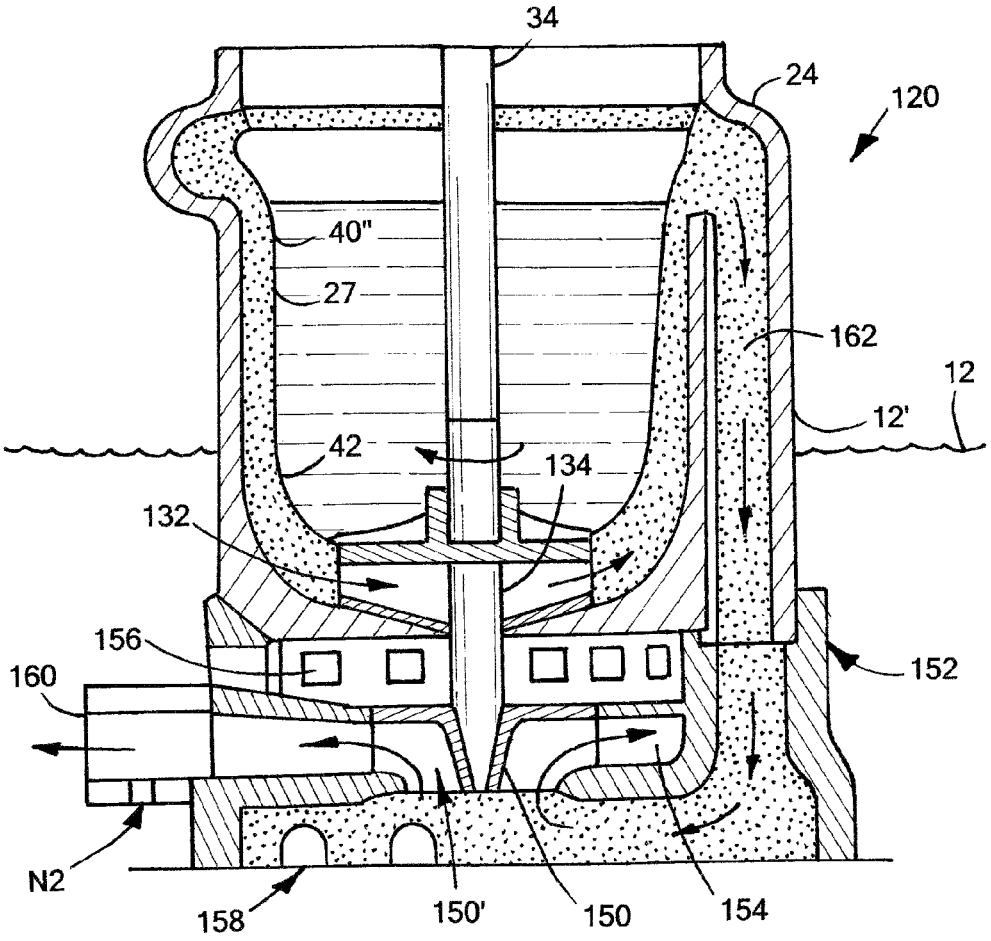
FIG. 13 is a side sectional view of an alternate pump embodiment having both a lifting pump impeller and recirculation pump impeller driven by a common drive shaft.

Referring now to FIG. 13 an alternate embodiment of the invention is illustrated. In this embodiment, denoted pump 120, two impellers are mounted coaxially upon a common drive shaft 34. The upper impeller 132 is substantially the same as either of the lifting impellers 32 or 32' discussed above. In the exemplary embodiment of pump 120 shown in FIG. 13, the mixing/pre-melting hybrid-drag turbine impeller 32' is shown generating a vortex 40', 40" within a third degree curvature vortex lifting cavity 42.

Pump 120 differs from the embodiments discussed above in that a second centrifugal impeller 150 is mounted to and rotates with the upper impeller 132.

Pump 120 has an extended or elongated drive shaft 134 which couples the two impellers 132, 150 coaxially. Pump 120 includes a pump housing 152 which supports the lifting vessel 26 and includes a volute 154 within which the second impeller 150 rotates. As shown in the FIG. 13 housing 152 has two inlet manifolds 156, 158 which each supply molten metal 12 to one of the two impellers. Inlet manifold 156 is in fluid communication with the inlet opening 30 of the lifting vortex vessel 26 to supply molten material to be lifted along the inner walls 27 of the vessel 26. A plurality of manifold apertures passing generally horizontally through the side walls of housing 152 permit the molten bath the be pulled into the vessel 26. Similarly, the lower inlet manifold 158 is in fluid communication with both the inlet openings 150' of the impeller 150 and the surrounding bath 12 by additional side apertures. In addition, the outlet 162 from the pre-melt vessel 26 joins the incoming flow from the surrounding bath 12 adding additional melting residence time before the mix is recirculated through the pump impeller 150 into the furnace hearth.

In the preferred embodiment the second impeller 150 is a recirculation impeller of a type such as my dual inducer impeller or my turbine impeller. The outlet of volute 154 may include a narrowing passage or throat 160, which operates to further increase the outlet velocity from the recirculation pump portion of pump 120. This increase velocity may be beneficial to allow for the ready injection of Nitrogen or Chlorine gas into the recirculating bath of molten metal 12 to clean the bath.

As shown, the upper outlet exit 24 for the lifting vessel 26 is in fluid communication with a passage 162 that passes down into the housing 152 and into the recirculation pump's manifold 158 wherein the molten metal that is lifted up (and ostensibly mixed with other materials, such as chips 50) within vessel 26 is immediately accelerated into the pool of molten metal 12 by the centrifugal impeller 150.

Figure 14:
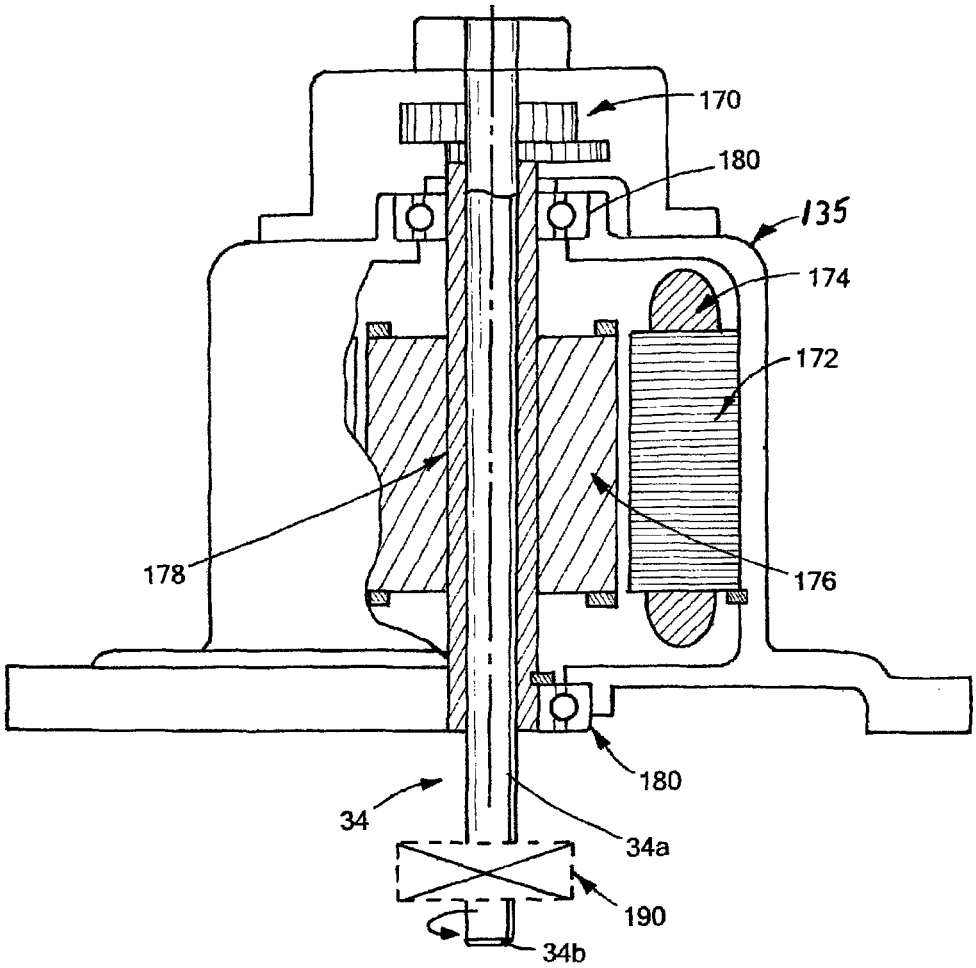
FIG. 14 is a side partial cut-away view of an alternate drive motor having coaxially mounted drive shafts; a mechanical gear train connects the two coaxial drive shafts.

Referring now to FIG. 14, the present invention further provides for an improved power transmission system or gear train 170, which mechanically transmits the rotational energy from a conventional motor 35 suitable for a molten metal furnace-environment to the drive shaft 34 of a molten metal pump, such as pumps 20, 20' and 120. As shown in the partially cut-away view, motor 35 has a fixed stator 172 and windings 174 which surround a rotor 176. The rotor 176 is fixed to a tubular motor shaft 178 which turns freely on bearings 180.

Importantly, tubular motor shaft 178 is linked at one end of gear train 170. The gear train 170 is configured in a conventional manner and is linked to and rotates the drive shaft 34. It should be appreciated that gear train 170 will be configured to reduce the motor's specific speed, while simultaneously increasing its torque in the same ratio. In one non-limiting embodiment, motor 35 is configured to rotate at 1800 RPM at its optimal efficiency, while the motor output shaft is geared down to rotate at 750 RPM. In the preferred embodiment, output shaft 34 is arranged to be concentric to and telescopically received within the tubular opening of motor shaft 178. In this manner, the packaging constraints of the pump/furnace can be limited, while setting the speed and torque of the rotating pump shaft 34. In the preferred embodiment, shaft 34 is formed from a solid bar of stainless steel to transmit the torque to the impeller. To avoid degradation of the steel shaft in the molten metal environment, conventional techniques of protecting the torque-transmitting shaft 34, such as encasing the shaft in a suitable ceramic shell/tube 34' (as best seen in FIG. 4) is preferred.

Figure 15:
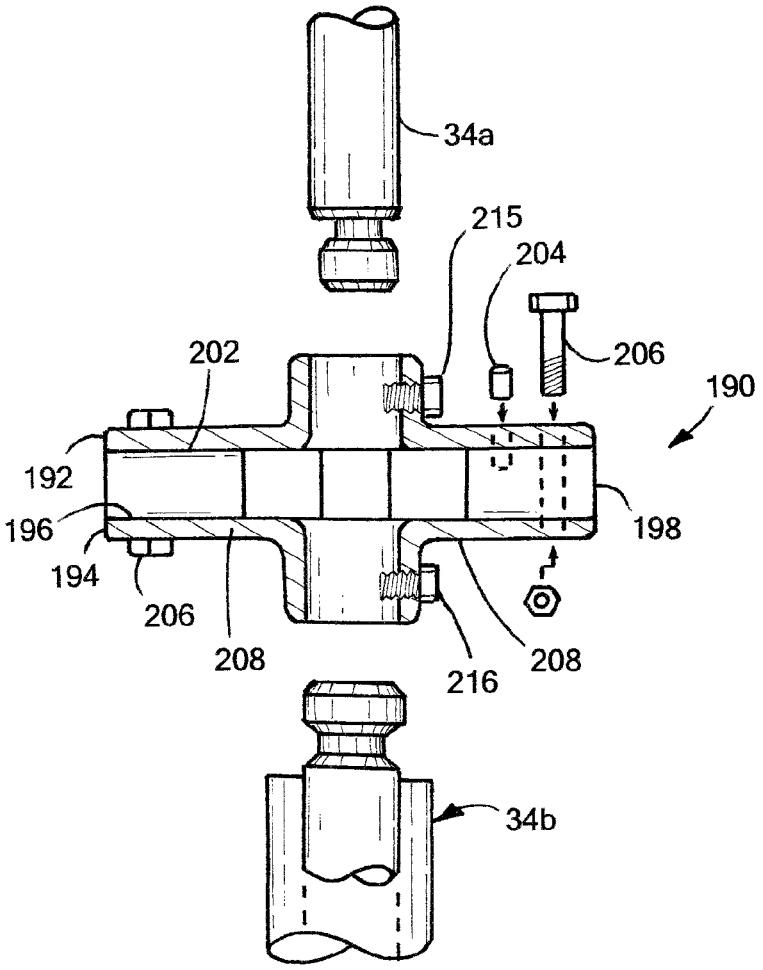
FIG. 15 is a side partially exploded view of a coupling having self-cooling feature and a thermally resistive configuration.

While in some non-limiting embodiments, shaft 34 may be directly passed down to the pump impeller, the present invention also discloses a thermal resistive coupling 190 which interconnects a split drive shaft, denoted **34*a* and 34*b* in FIG. 15. Coupling 190 is preferably formed from a ceramic low thermal conductivity material (e.g., alumina titanate or zirconium silicate) and includes a stainless steel top plate 192 which is fixed to the upper drive shaft 34*a* by means of a bolt 215, which is driven by motor 35. In the exemplary coupling 190 of FIG. 15, the drive shaft 34*a* is similarly fastened to a complementary fitting within top plate 192**.

Coupling 190 also includes a lower plate 194, which has a generally round and flat base 196 and a plurality of radially spaced monolithic low conductivity ceramic vanes or spacers 198 extending vertically from the base 196. Opposite of the spacers 198 is another fitting formed in the lower face of the base 196 which permits the lower plate 194 to be fixed to the lower drive shaft 34*b*.

Figure 16:
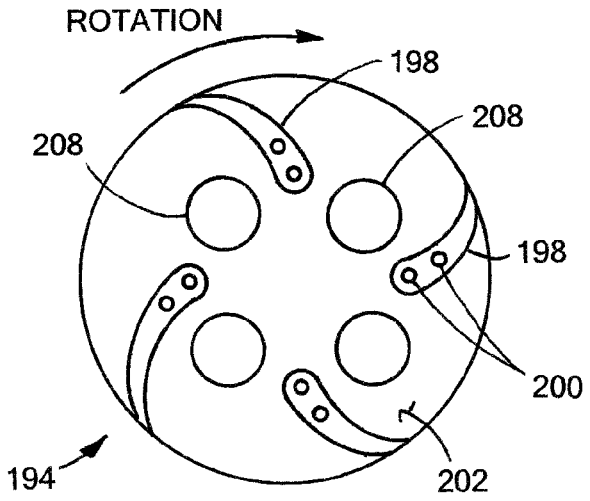
FIG. 16 is a top view of the lower portion of the thermal coupling shown in FIG. 15.

Each vane 198 includes coupling apertures 200 formed into the top surface 202. A plurality of complementary apertures are formed in top plate 192 allow the top and lower plates to be coupled together by drive pins 204 and mechanical fasteners, such as bolts 206, to assemble the coupling 190. In addition to the coupling apertures 200, the top and lower plates 192, 194 include air passages 208 formed between the spaced vanes 198. As shown best in FIG. 16, when the coupling 190 is assembled and joins the shafts 34*a*, 34*b*, the rotation of the coupling resulting in air to be pulled into the passages 208 and out between the vanes 198. In this manner, there is little to no heat transferred from the lower drive shaft 34*b* (extending out from the molten bath 12) to the upper drive shaft 34*a* and the transmission 170 and/or motor 35. In other non-limiting embodiments, the lower portion of the shaft 34 can be made from graphite with a ceramic sleeve to protect it from burning at the metal line. Further embodiments may also be nitrogen gas impregnated through the upper shaft portion.

Figure 17:
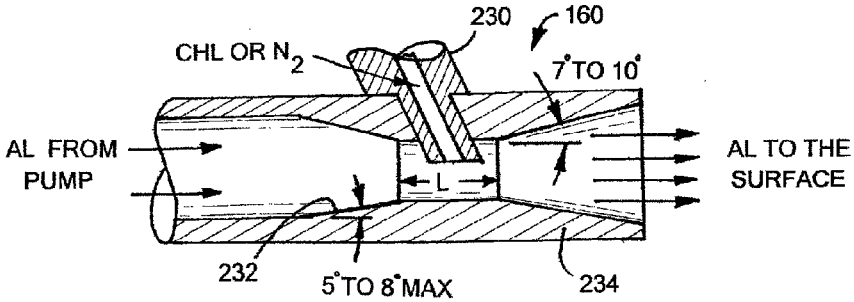
FIG. 17 is a side sectional view of a recirculation pump throat including an inert gas injection port.

Referring now to FIGS. 13 and 17, throat 160 is shown receiving the flow ejected from the recirculation pump (impeller 150 and volute 154) portion of the pump. To facilitate the effective introduction of an inert gas into the flow of molten metal, the flow from a recirculation-type impeller, such as impeller 150, must be accelerated to between twenty-eight and thirty feet per second to achieve an ideal sonic ratio which creates a suction force within the throat, thereby pulling the injected inert gas, via injection port 230 formed in the throat 160. To accelerate the flow, a narrowing or restriction 232 is formed within the tubular throat. The restriction preferably decreases the cross-sectional area of the throat gradually by narrowing gradually at a slight angle, less than eight degrees and preferably between five and eight degrees. The throat 160 may also include a diffuser portion 234, which is formed downstream of the inert gas injection port 230. Diffuser 234 gradually increases the cross-sectional area of the throat to slow the flow of molten metal to a more acceptable rate (e.g., between fourteen and twenty feet per second). In one non-limiting embodiment, the diffuser gradually angles outwardly between seven and ten degrees to limit the turbulence and/or cavitation from the slowing of the flow.

The present invention, by increasing the flow rates and combining a lifting pump (mixing and/or pre-melting) with a recirculation pump increases the amount of molten metal which flows through the furnace thereby improving the overall efficiency of the furnace by maintaining desirable recirculation velocities while at the same time providing a pre-melting apparatus having increased dwell time for chips melt.

From the foregoing description, one skilled in the art will readily recognize that the present invention is directed to an improved molten metal pump system that rotates the molten metal within an internal cavity creating a vortex of molten metal along the vertical cavity wall, which rises up to an outlet at the upper end of the wall. Further, a pump including both a lifting impeller and a recirculation impeller are provided which reduces the footprint within the furnace wells. The present invention, through its novel use of a mechanical transmission to boost torque while reducing output speeds allows the pump's motor to operate at or near peak efficiency and eliminates the necessity to employ over powered motors to generate the necessary torques at the relatively low speeds required of molten metal pumping operations.

While the present invention has been described with particular reference to various preferred embodiments, one skilled in the art will recognize from the foregoing discussion and accompanying drawing and claims that changes, modifications and variations can be made in the present invention without departing from the spirit and scope thereof.

The invention claimed is:

1. A molten metal pump comprising: an elongated body having a vertical tubular wall having an internal cavity defined by an inner wall terminating in a bottom end; and a first centrifugal impeller seated in an opening formed in a center of said bottom end; a second centrifugal impeller mounted coaxially with the first centrifugal impeller, wherein said second centrifugal impeller is a recirculation pump impeller; a pump motor which rotates a first drive shaft; a second drive shaft which is fixed to said first impeller; and a thermally resistive coupling mounted between and interconnecting said first drive shaft and said second drive shaft, wherein said coupling includes a plurality of radially spaced vanes which draw ambient air into and then out of said coupling as said coupling is rotated; and whereby rotation of the first impeller and the second impeller results in the ejected flow of molten metal from the first impeller to create an uplifting vortex which climbs the inner wall to an outlet opening passing through an upper portion of said body and simultaneously recirculating a bath of molten metal.

2. The pump as defined in claim 1, wherein said tubular wall has a curvature which aids forming and sustaining of one of the following vortices: a forced vortex; a highly forced vortex; and a super forced vortex.

3. The pump as defined in claim 2, wherein said forced vortex has a constant angular velocity.

4. The pump as defined in claim 1, wherein the bottom end has a take-off angle between zero degrees and fifteen degrees from the horizontal.

5. The pump as defined in claim 1, wherein a diameter of the vessel inner wall is from 1.5 to 4 times an outer diameter of the first impeller.

6. The pump as defined in claim 1, wherein the outlet opening of said vessel is at least three feet to seven feet above the bottom end of the internal cavity.

7. The pump as defined in claim 1, wherein the first impeller is a centrifugal pump impeller generating a high velocity mixed flow with a specific speed ranging from 1,000 to 3,000 RPM.

8. The pump as defined in claim 1, further comprising a gear box coupled to said first drive shaft which reduces an output speed of the motor and increases torque from the motor.

9. A pre-melting and recirculating pump for a furnace having a bath of molten metal, comprising: a vertical riser tube having an inner wall which defines an internal cavity and having outlet means formed at an upper end of the tube which fluidly connects the internal cavity to an outer opening; a first centrifugal impeller rotatably seated coaxially within an opening formed in a center of a bottom end of said riser tube, wherein molten metal ejected from the first impeller is received by said inner wall, whereby rotation of the first impeller results in molten metal ejected from the first impeller forming a lifting vortex within said riser tube and along said inner wall, said vortex climbs the inner wall to said outlet means; and a second centrifugal impeller mounted coaxially to said first impeller, said second impeller having an outlet velocity which recirculates said bath of molten metal within said furnace; and a pump housing, said pump housing include a lifting impeller inlet manifold and a separate recirculation impeller inlet manifold.

10. The pre-melting and recirculating pump as defined in claim 9, wherein said internal cavity has a shape selected from the following: a square type curve and a cubic type curve.

11. The pre-melting and recirculating pump as defined in claim 9, wherein said vortex has a substantially uniform thickness along said inner wall and above said bottom end.

12. The pre-melting and recirculating pump as defined in claim 9, further comprising means for mixing solid particulate matter within said vortex, wherein said means for mixing is formed within an upper face of said lifting impeller and is effective to redirect said solid particulate matter radially into said vortex.

13. The pre-melting and recirculating pump as defined in claim 9, wherein said vortex has a constant angular velocity.

14. The pre-melting and recirculating pump as defined in claim 9, wherein said outer opening is fluidly coupled to the recirculation impeller inlet manifold.

15. The pre-melting and recirculating pump as defined in claim 9, further comprising: a pump motor which rotates a tubular motor shaft; a gear train coupled to said motor shaft, which reduces an output speed of the motor and increases torque from the motor; and a drive shaft coupled at one end to said gear train and receiving said torque and extending concentrically down through the tubular motor shaft and fixed to said first impeller.

16. The pre-melting and recirculating pump as defined in claim 15, wherein said drive shaft comprises a first portion which is coupled to said gear train and a second portion which is fixed to said first impeller; further comprising: a thermally resistive coupling mounted between and interconnecting said first portion and said second portion of said drive shaft, wherein said coupling top plate fixed to said first portion and a lower plate fixed to said second portion, said coupling including a plurality of low conductivity ceramic radially spaced vanes fixed between said top and lower plate.

17. The pre-melting and recirculating pump as defined in claim 9, wherein said second centrifugal impeller ejects a flow of molten metal through an outlet, further comprising: a throat coupled to said outlet and which receives said ejected flow of molten metal, wherein said throat includes means to accelerate said flow of said molten metal; and means for injecting an inert gas within said throat.

18. The pre-melting and recirculating pump as defined in claim 17, wherein said means to accelerate comprises a restriction which accelerates said flow to a velocity of twenty-eight to thirty feet per second.

19. A pre-melting and recirculating pump for a furnace having a bath of molten metal, comprising: a vertical riser tube having an inner wall which defines an internal cavity and having outlet means formed at an upper end of the tube which fluidly connects the internal cavity to an outer opening; a first centrifugal impeller rotatably seated coaxially within an opening formed in a center of a bottom end of said riser tube, wherein molten metal ejected from the first impeller is received by said inner wall, whereby rotation of the first impeller results in molten metal ejected from the first impeller forming a lifting vortex within said riser tube and along said inner wall, said vortex climbs the inner wall to said outlet means; and a second centrifugal impeller mounted coaxially to said first impeller, said second impeller having an outlet velocity which recirculates said bath of molten metal within said furnace, and wherein said second centrifugal impeller ejects a flow of molten metal through an outlet; said outlet further comprising a throat coupled to said outlet which receives said ejected flow of molten metal, wherein said throat includes means to accelerate said flow of said molten metal and means for injecting an inert gas within said throat.

* * * * *